US010593170B2

(12) United States Patent
DiPoala

(10) Patent No.: US 10,593,170 B2
(45) Date of Patent: Mar. 17, 2020

(54) DOOR/WINDOW MAGNETIC SENSING DEVICE AND METHOD OF INSTALLING

(71) Applicant: Robert Bosch GmbH, Stuttgart (DE)

(72) Inventor: William DiPoala, Fairport, NY (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 15/780,394

(22) PCT Filed: Dec. 29, 2016

(86) PCT No.: PCT/US2016/069227
§ 371 (c)(1),
(2) Date: May 31, 2018

(87) PCT Pub. No.: WO2017/117397
PCT Pub. Date: Jul. 6, 2017

(65) Prior Publication Data

US 2018/0365943 A1 Dec. 20, 2018

Related U.S. Application Data

(60) Provisional application No. 62/274,000, filed on Dec. 31, 2015.

(51) Int. Cl.
*G08B 13/08* (2006.01)
*G08B 29/22* (2006.01)
*G08B 29/04* (2006.01)

(52) U.S. Cl.
CPC ..... *G08B 13/08* (2013.01); *G08B 29/046* (2013.01); *G08B 29/22* (2013.01)

(58) Field of Classification Search
CPC ..... G08B 13/08; G08B 29/22; G08B 29/046
See application file for complete search history.

(56) References Cited

U.S. PATENT DOCUMENTS 4,866,426 A * 9/1989 Evans ..... G08B 13/06 340/541
5,668,533 A * 9/1997 Jackson, Jr. ..... H01H 36/0026 335/205

(Continued)

FOREIGN PATENT DOCUMENTS

EP 2163713 A2 3/2010
EP 2711905 A2 3/2014

(Continued)

OTHER PUBLICATIONS

International Search Report and Written Opinion of the International Searching Authority for Intl. Appl. No. PCT/US2016/069227 (dated Jul. 27, 2017).

(Continued)

*Primary Examiner* — Ryan W Sherwin
(74) *Attorney, Agent, or Firm* — Michael Best & Friedrich LLP

(57) ABSTRACT

A door/window magnetic sensing device includes a housing, a magnetic sensor disposed in the housing and configured to sense signal strength of a magnet and output a signal strength value, and a controller for receiving a signal strength value from the magnetic sensor. The controller is configured to compare the signal strength value to an alarm threshold value and output one of a normal state signal and an alarm state signal. Further, a tamper state is detected from the approach of a second magnet. An indicator assists in mounting the door/window magnetic sensing device and mounting a magnet assembly.

16 Claims, 8 Drawing Sheets

(56) References Cited

U.S. PATENT DOCUMENTS

| | | | | |
|---|---|---|---|---|
| 8,269,627 | B2 | 9/2012 | Gore et al. | |
| 2006/0250297 | A1* | 11/2006 | Prakah-Asante | B60R 21/0134 342/70 |
| 2007/0139195 | A1 | 6/2007 | Jin et al. | |
| 2009/0102649 | A1 | 4/2009 | Diener et al. | |
| 2010/0102907 | A1 | 4/2010 | Schebel et al. | |
| 2010/0218569 | A1 | 9/2010 | Hunt et al. | |
| 2012/0112910 | A1 | 5/2012 | Meyers | |
| 2015/0348385 | A1 | 12/2015 | Lamb et al. | |
| 2016/0298950 | A1* | 10/2016 | Modi | G01B 7/14 |

FOREIGN PATENT DOCUMENTS

| | | | |
|---|---|---|---|
| JP | 2008288030 | A | 11/2008 |
| JP | 2010129010 | A | 6/2010 |
| WO | 2014/138776 | A1 | 9/2014 |

OTHER PUBLICATIONS

International Preliminary Report on Patentability for Application No. PCT/US2016/069227 dated Jul. 12, 2018 (13 pages).

Examination Report No. 1 from the Intellectual Property Office of Australia for Application No. 2016380353 dated Sep. 11, 2018 (3 pages).

Office Action from the State Intellectual Property Office of the People's Republic of China for Application No. 20168007714.3 dated Jul. 15, 2019 (12 pages).

* cited by examiner

DOOR/WINDOW MAGNETIC SENSING DEVICE AND METHOD OF INSTALLING

RELATED APPLICATIONS

This application claims priority from U.S. provisional application 62/274,000, filed Dec. 31, 2015, the entire content of which is hereby incorporated by reference.

BACKGROUND

The present invention relates to door/window magnetic sensor for sensing the opening and closing of a door or window Prior art door/window magnetic sensing devices use a reed switch so only the open or closed state of the reed switch is known. A magnet must be positioned close to the switching point of a reed switch, which has a limited distance range for switching. The field applied by the magnet to the reed switch may also vary a small amount in a particular installation due to normal amount of play in the door latching mechanism and seal (weather strip). This limited change in position of the magnet relative to the reed switch may lead to a false alarm when a door moves even slightly, for instance, due to a wind storm or due to a barometric pressure change.

Another issue with the traditional reed switch and magnet door sensors is that a would-be thief can simply place a second magnet on the reed switch housing. The second magnet keeps the reed switch in its normal state even when the door is opened. The thief returns later to open the door and goes undetected.

Finally, in many instances mounting a magnet near a traditional reed switch can be difficult as there is uncertainty whether the magnet and reed switch are within an appropriate distance during installation.

SUMMARY

In one embodiment, the invention provides a door/window magnetic sensing device comprising: a magnetic sensor configured to sense signal strength of a magnet and output a signal strength value, and a controller for receiving the signal strength value from the magnetic sensor. The controller is configured to determine an alarm state, a normal state, and a tamper state from the signal strength value.

In another embodiment, the magnetic sensor is a Hall effect sensor that provides an output voltage when no magnetic field is sensed thereby.

In another embodiment, the invention provides a door/window magnetic sensing device comprising: a housing, a magnetic sensor disposed in the housing and configured to sense signal strength of a magnet and output a signal strength value, and a controller for receiving the signal strength value from the magnetic sensor. The controller is configured to compare the signal strength value to an alarm threshold value and output one of a normal state signal and an alarm state signal.

In one embodiment the controller is configured to store the signal strength value provided by the magnetic sensor when a magnet is present corresponding to a closed door or closed window for at least a preselected number of occurrences. The controller processes the stored signal strength values to determine an average operational signal strength value.

In another embodiment, the invention provides a method for installing a door/window magnetic sensing device and a magnet assembly for a door sensing arrangement including mounting one of the magnet assembly and the door/window magnetic sensing device to a door or a door frame and mounting the other of the magnet assembly and the door/window magnetic sensing device to the other of the door or the door frame. The mounting includes providing an indication that the magnet assembly and the door/window magnetic sensing device are too far apart to perform door sensing and providing an indication that the magnet is being detected by a magnetic sensor of the door/window magnetic sensing device as one of the magnet assembly and the door/window magnetic sensing device approaches the other of the magnet assembly and the door/window magnetic sensing device. The method includes providing an indication that the door/window magnetic sensing device is approaching or moving away from the magnet assembly corresponding to an increase or decrease in a signal strength of the magnet sensed by the magnetic sensor; and indicating that the magnet and the magnetic sensor are moved to a position that corresponds to the door/window magnetic sensing device and the magnet assembly being in a closed or shut position and the signal strength of the magnet sensed by the magnetic sensor exceeds a signal strength margin. Then the approaching one of the magnet assembly and the door/window magnetic sensing device is secured to the other of the door and the door frame at the position wherein the magnetic sensor detects the signal strength of the magnet that exceeds the signal strength margin.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
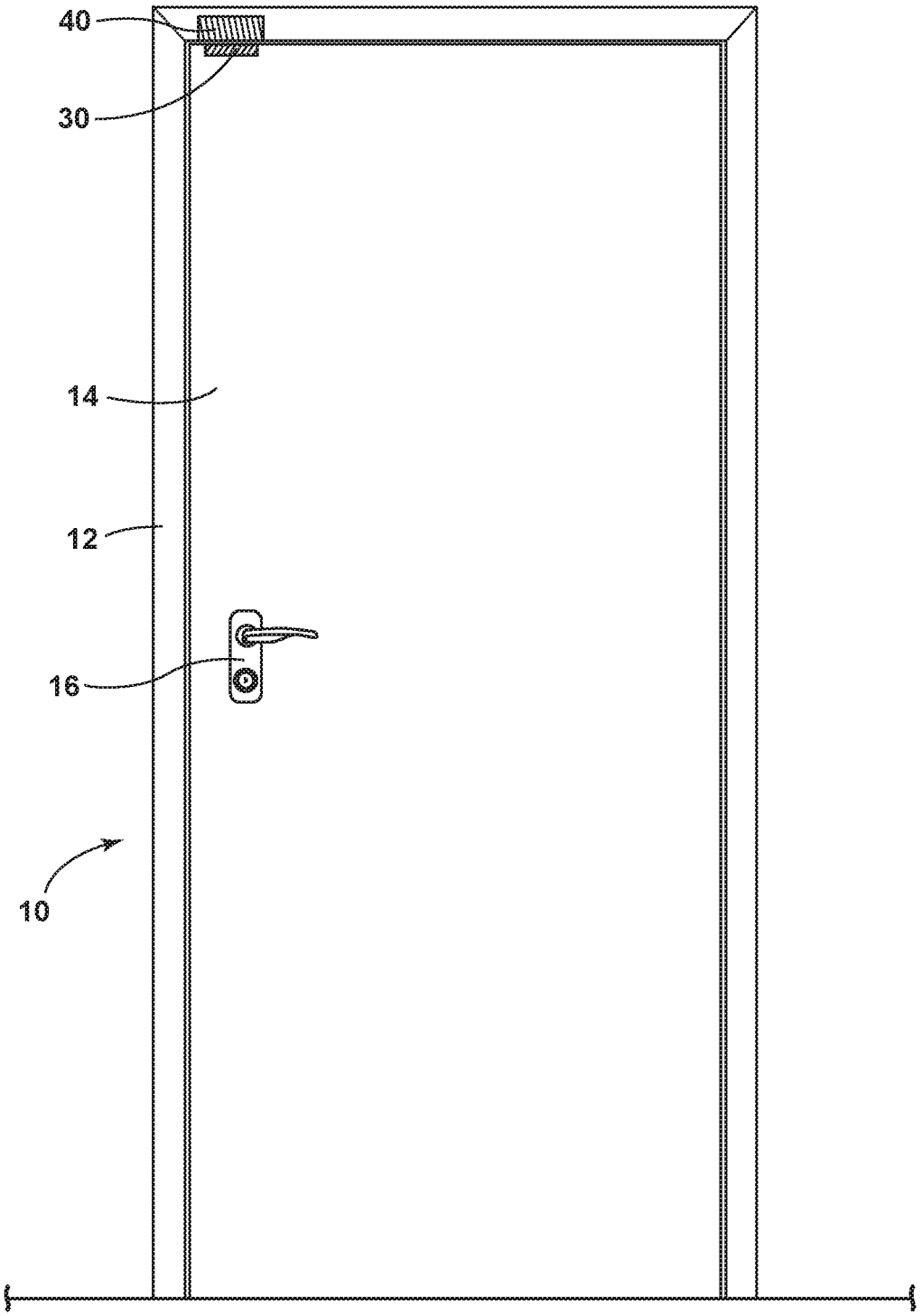
FIG. 1 shows a front view of a door arrangement that includes a magnet assembly and a door/window magnetic sensing device.

FIG. 1 shows one embodiment of a door sensing arrangement 10. The door sensing arrangement 10 includes a door frame 12 and a door 14 mounted thereto. The door 14 includes a door handle 16 for entering a room defined by the door frame 12. Further, FIG. 1 shows a magnet assembly 30 secured to the door 14 and a door/window magnetic sensing device 40 secured to the door frame 12 in this embodiment.

Figure 2:
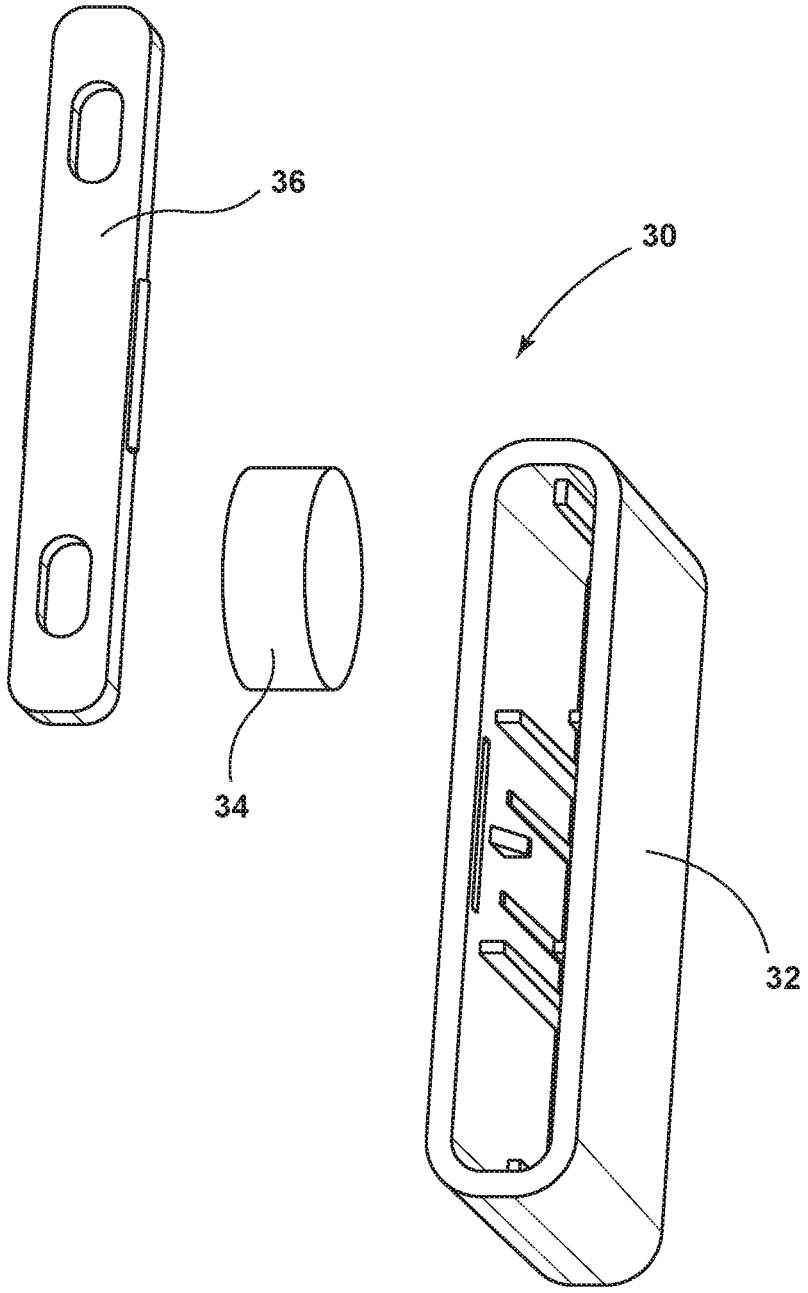
FIG. 2 is an exploded view of a magnet assembly.

FIG. 2 is an exploded view of a magnet assembly 30 that includes a magnet housing 32 and a magnet 34 that is disposed therein. The magnet assembly 30 includes a magnet housing mounting plate 36 for mounting the magnet assembly 30 to the door 14 in FIG. 1.

Figure 3:
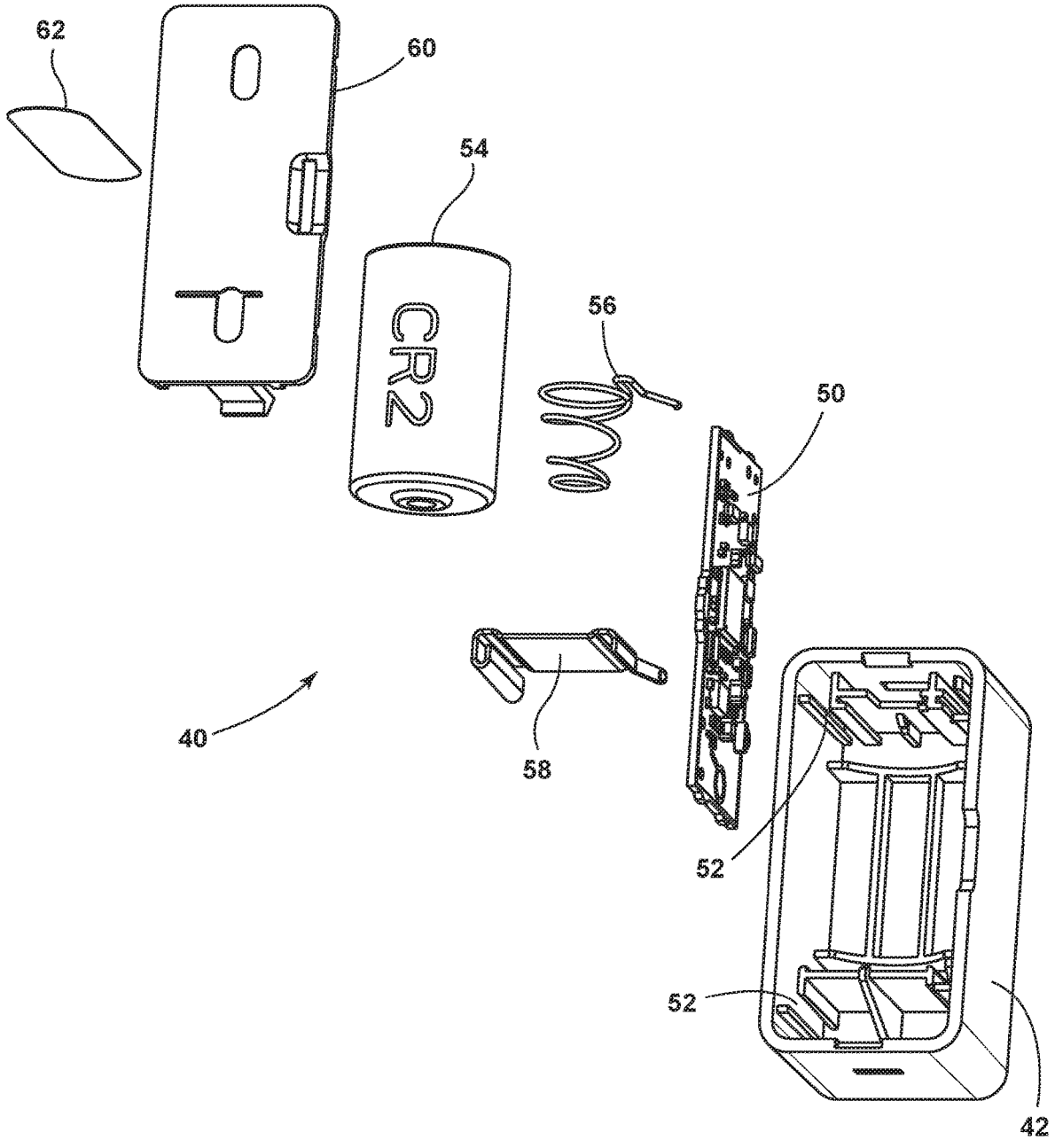
FIG. 3 is an exploded view of a door/window magnetic sensing device.

FIG. 3 is an exploded view of the door/window magnetic sensing device 40. The door/window magnetic sensing device 40 includes an enclosure housing 42. The enclosure housing 42 is configured to receive a printed circuit board 50 in a slot 52 defined by elements in two corners thereof. The enclosure housing 42 is also configured to receive a battery 54, a battery coil spring 56 and a battery contact leaf spring 58. The door/window magnetic sensing device 40 includes a mounting plate 60 for mounting to a door 14 or door frame 12. A battery pull tab insulator 62 is removed so the battery 54 in the enclosure housing 42 provides power.

In FIG. 3, the printed circuit board 50 is mounted in the enclosure housing 42 transverse to the wall defined by the mounting plate 60. Thus, some of the components on the printed circuit board 50 are spaced away from the door 14 in a mounted arrangement.

Figure 4:
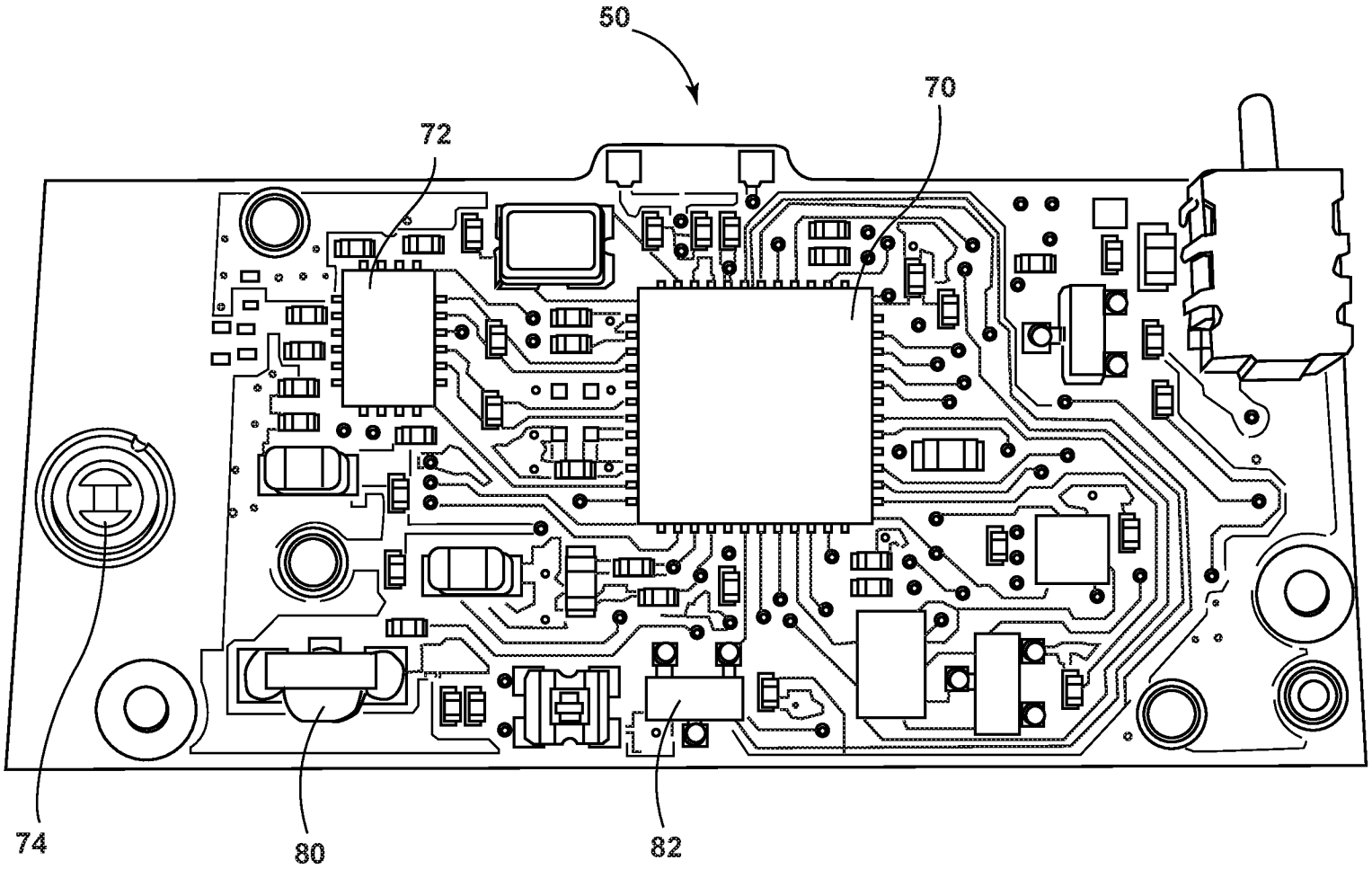
FIG. 4 is a perspective view of a printed circuit board of the door/window magnetic sensing device.

FIG. 4 shows the printed circuit board 50. The printed circuit board 50 includes an electronic controller 70 and a front end module 72 with a radio frequency (RF) power amplifier. Further, the printed circuit board 50 includes an antenna 74. The printed circuit board 50 includes a light emitting diode (LED) indicator 80 and a magnetic sensor, such as the Hall effect sensor 82 shown in FIG. 4. Other integrated circuits, resistors, capacitors and the like are shown to provide power to various elements and to provide communication between various elements of the printed circuit board 50. In one embodiment, a memory is provided on the printed circuit board 50 in communication with the controller 70 for storing information and/or instructions.

The Hall effect sensor 82 shown in FIG. 4 is mounted on the printed circuit board 50 on a side thereof that is first inserted into the enclosure housing 42 shown in FIG. 3. Thus, the Hall effect sensor 82 is far from the mounting plate 60 when the door/window magnetic sensing device 40 is assembled. As shown in FIG. 3, the printed circuit board 50 is disposed within the enclosure housing 42 in the slot 52 so upon assembly, the printed circuit board is oriented transverse to the mounting plate 60. Thus, the Hall effect sensor 82, the LED indicator 80 and the antenna 74 are disposed on the printed circuit board 50 away from the mounting plate 60. The mounting plate 60 is mounted in surface-to-surface contact with a door frame 12 as shown in FIG. 1. Then the enclosure housing 42 with contents is secured thereto.

Figure 5:
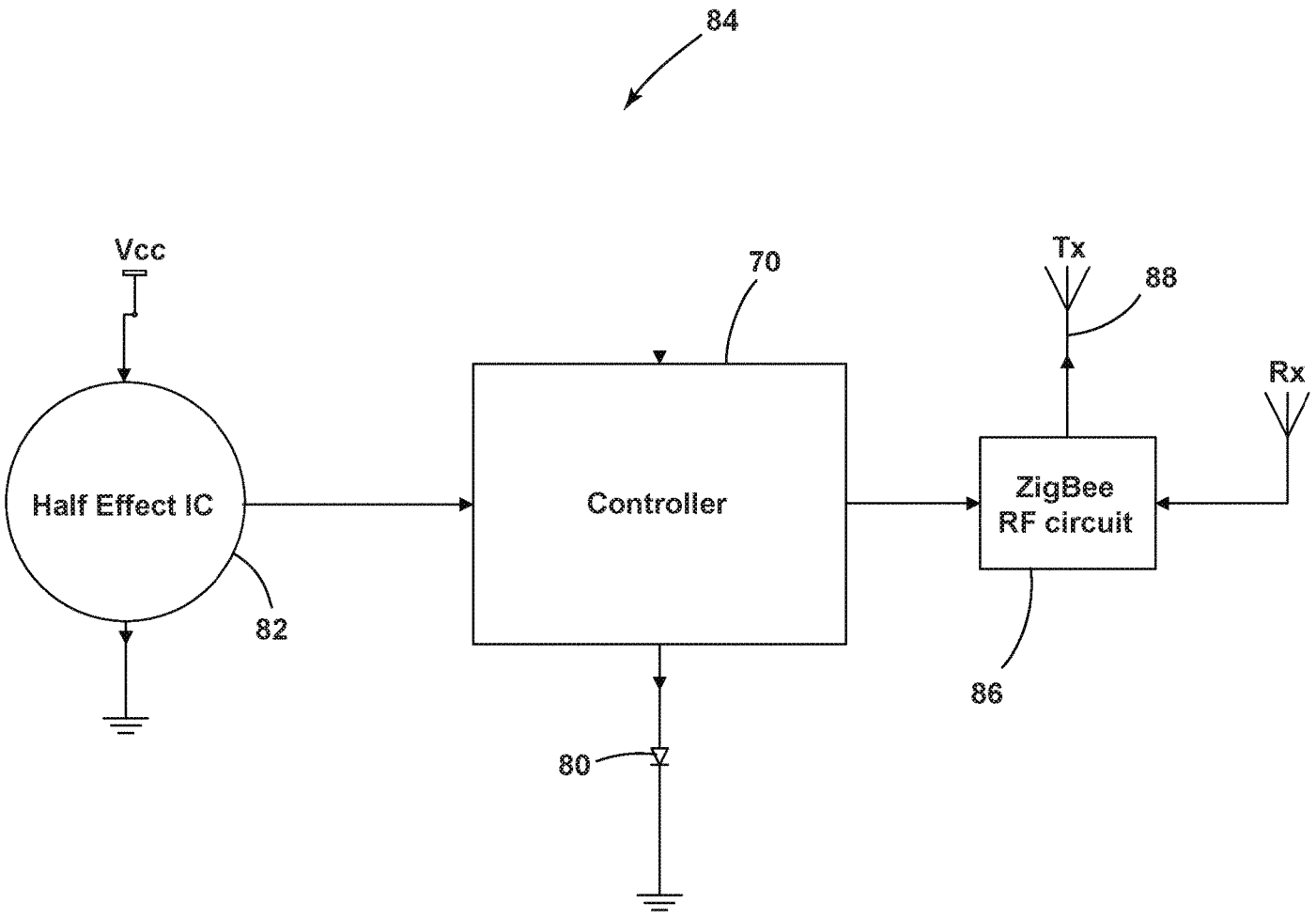
FIG. 5 is a block diagram of the door/window magnetic sensing device.

FIG. 5 shows a block diagram 84 of relevant components of the door/window magnetic sensing device 40. The block diagram 84 includes the controller 70 that is configured to receive an analog input from the hall effect sensor 82. The controller 70 provides an output to a wireless transmitter circuit 86, such as a Zigbee RF circuit, for broadcasting via an antenna 88 to a user interface and/or a control panel. FIG. 5 shows the indicator 80 for receiving and visually displaying an output from the controller 70. The indicator 80 displays an alarm state and also assists in mounting the door/window magnetic sensing device 40 and the magnet assembly 30 to the door frame 12 or the door 14.

Figure 6:
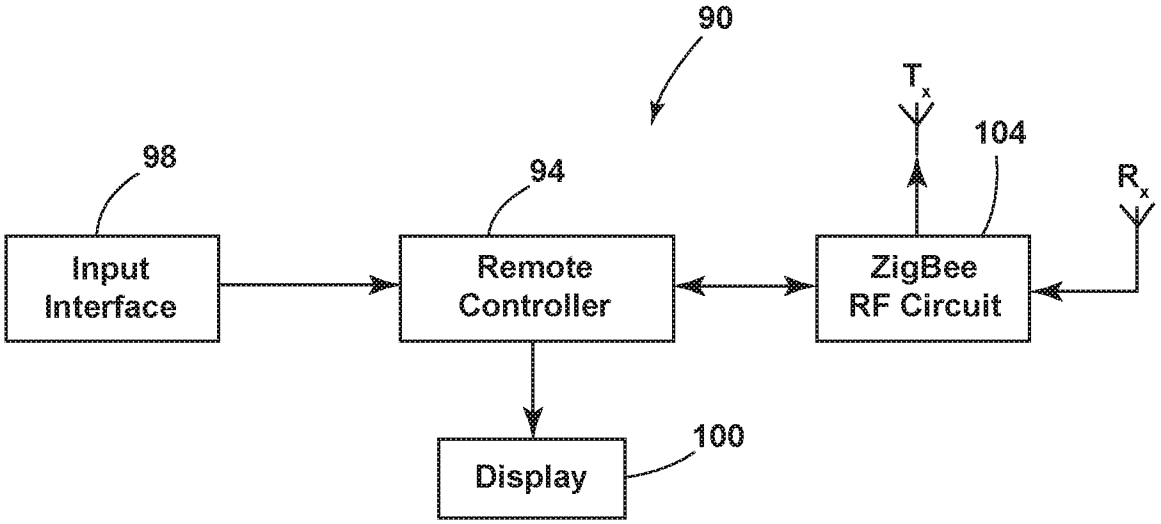
FIG. 6 is a block diagram of a remote device.

FIG. 6 shows a block diagram of a remote device 90 that includes a remote electronic controller 94 that is configured to receive inputs from an input interface 98 and provide outputs to a display 100. The remote controller 94 communicates with a wireless receiving circuit 104, for receiving via an antenna 108 signals from the door/window magnetic sensing device 40. In one embodiment, the remote device 90 is carried by an installer. In another embodiment, the remote device 90 is a central station and the display 100 is an alarm control panel for displaying the status of a plurality of door/window magnetic sensing devices and other information.

Method of Installing the Door Arrangement

The LED indicator 80 is used to help a security system installer mount the magnet assembly 30 and door/window magnetic sensing device 40 in positions that have a sufficient signal strength margin to prevent false alarms. The indicator 80 illuminates continuously when the magnet 34 within the magnet assembly 30 is too far away from the door/window magnetic sensing device 40. As the magnet 34 approaches the door/window magnetic sensing device 40, the LED indicator 80 starts to flash slowly indicating that the presence of the magnet is detected but does not have the proper signal strength margin. As the magnet 34 is moved closer to the door/window magnetic sensing device 40, the LED indicator flash rate increases. In response to the detection of a proper signal strength margin, the LED indicator 80 stops flashing and is off, which notifies the installer that this is a proper location to mount the magnet assembly 30 or the door/window magnetic sensing device 40. In another embodiment, the LED indicator 80 starts to flash quickly, and as the magnet 34 approaches the door/window magnetic sensing device 40, the rate of flashing reduces and eventually the LED indicator stops when mounting is proper. Signal strength margin provides a margin beyond the signal strength whereat the magnetic sensing device 40 merely detects the presence of the magnet 34. Thus, when the signal strength of the magnet 34 measured by the door/window magnetic sensing device 40 exceeds the signal strength margin, the magnet assembly 30 and the door/window magnetic sensing device 40 can be affixed to the door or door frame, respectively. The signal strength margin prevents minor movements and changes in the orientation of the magnet 34, for example, from compromising the operation of the door sensing arrangement 10.

Figure 7:
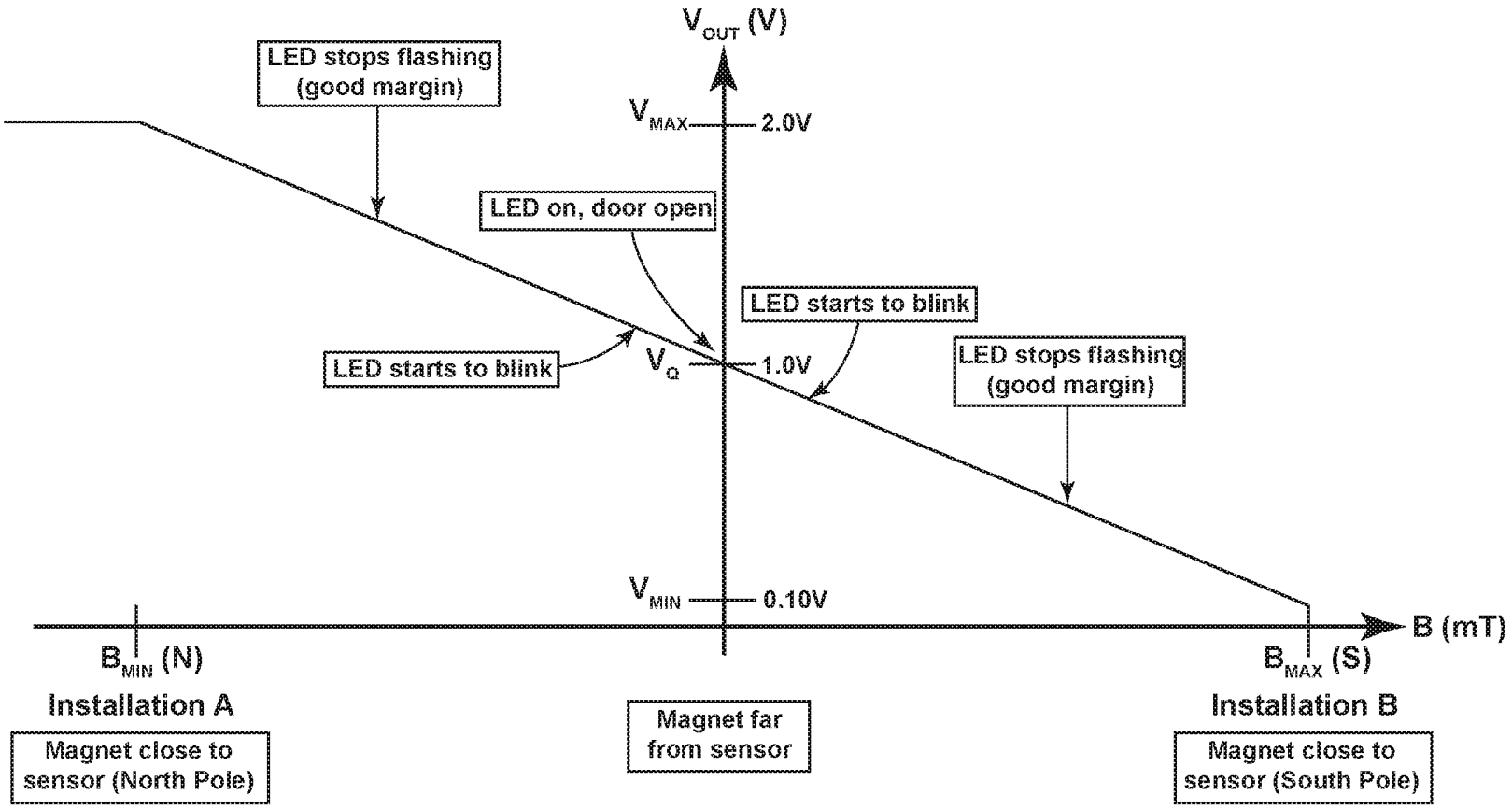
FIG. 7 is a graph of voltage of the Hall effect sensor and magnetic field strength.

There are two different voltage arrangements for the installation and subsequent operation of the magnet assembly 30 and the door/window magnetic sensing device 40 as shown in FIG. 7. The magnet 34 shown in FIG. 2 has a north pole side ($B_{MIN}$) and a south pole side ($B_{MAX}$). During installation, the sides of the magnet 34 with the poles are disposed in the magnet housing 32 and are not viewable by an installer. Further, depending on space and mounting locations on a door or a door frame, the magnet 34 is oriented in different ways with respect to the Hall effect sensor 82 of the door/window magnetic sensing device 40. Thus, the controller 70 and the Hall effect sensor 82 account for any orientation of the magnet 34 relative to the Hall effect sensor 82 of the door/window magnetic sensing device 40 as follows.

When the Hall effect sensor 82 senses an increase or decrease in voltage upon the approach of a magnet 34, the controller 70 immediately identifies whether a north pole of a magnet is approaching (Installation A in FIG. 7) or a south pole is approaching (Installation B in FIG. 7). Thus, the controller 70 provides the appropriate threshold values for starting to flash the LED indicator 80 and for stopping or turning off the LED indicator.

When the Hall effect sensor 82 is not near a magnet 34, the voltage output thereby is about 1.0 volt. Installation A is shown to the left of the voltage ($V_{OUT}$) line extending upwardly. Installation A represents the instance wherein the north pole of the magnet 34 of the magnet assembly 30 is oriented toward the Hall effect sensor 82. The orientation results in the voltage output by the Hall effect sensor 82 increasing with the magnetic field, which is also known as the magnetic flux density $B_{MIN}$ measurable in millitesla (mT) as the magnet 34 approaches the Hall effect sensor 82. Thus, the controller 70 controls the LED indicator 80 to illuminate steady when no magnet 34 is sensed by the Hall effect sensor 82 or is barely sensed as the magnet and Hall effect sensor are too far apart, until the voltage sensed thereby increases due to the nearing of the presence of the magnet 34 so that the controller causes the LED indicator 80 to start blinking. As shown toward the left in FIG. 7, when the voltage increases due to the increasing $B_{MIN}$ value, the LED indicator stops flashing indicating a good signal strength margin for detection of the magnet 34 by the Hall effect sensor 82 representing a closed door or a closed window. At this location, the magnet assembly 30 and the door/window magnetic sensing device 40 are both secured to a door and door frame or secured to a window and window frame, respectively.

FIG. 7 also illustrates the effect of a magnetic field from a south pole of the magnet 34 on the Hall effect sensor 82 as shown by Installation B. As the south pole of the magnet 34 of the magnet assembly 30 approaches or is approached by the Hall effect sensor 82, the voltage output by the Hall effect sensor 82 decreases from 1.0 volts and the LED indicator 80 provides a steady illumination. After the voltage output by the Hall effect sensor 82 drops to about 0.9 volts, the LED indicator 80 starts to blink. The flash rate for illuminating of the indicator 80 varies as the magnet 34 approaches and the flash rate changes to indicate that the magnet is approaching or moving away. Once the magnet 34 is within a reasonable signal strength margin with respect to the Hall effect sensor 82 and approaching magnetic flux density $B_{MAX}$, the blinking of the LED indicator 80 stops. Then, an installer mounts the magnet assembly 30 and the door/window magnetic sensing device 40 to ensure that a proper distance is provided therebetween for error free operation by avoiding false alarm conditions.

Averaging Hall Effect Sensor Output Voltage (Door Closed)

As set forth above, during setup or installation, the controller 70 determines whether a north pole or a south pole of the magnet 34 is approaching the Hall effect sensor 82 and operates as set forth above. Thus, the controller 70 is configured to determine the orientation of a magnetic field sensed by the Hall effect sensor 82 from the signal strength value corresponding to the output voltage to select an alarm threshold value based on the orientation of the magnetic field.

Figure 8:
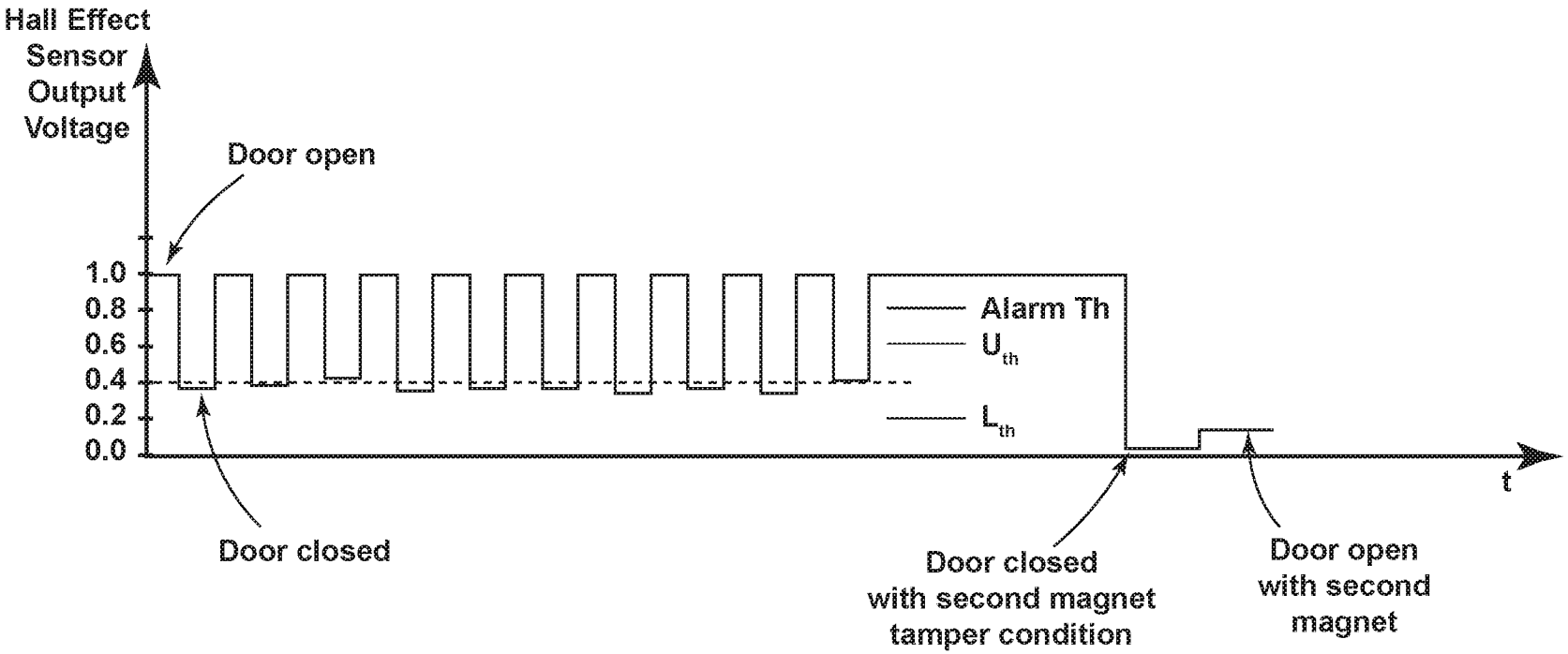
FIG. 8 is a graph of output voltage of the Hall effect sensor versus time.

The controller 70 also establishes and maintains a rolling average value of the signal strength from the output voltage of the Hall effect sensor 82 when the door is in the closed state. FIG. 8 shows a waveform that corresponds to repeated opening and closing of the door. In the door open positions, the output voltage of the Hall effect sensor is about 1.0 volt. Upon each door closing position of the door in FIG. 8, the output voltage of the Hall effect sensor is about 0.4 volts, which corresponds to Installation B in FIG. 7. As shown in FIG. 8, the magnet strength and thus the output voltage varies from door closing event to door closing event or occurrence. The output voltage may vary a small amount in a particular installation due to a normal amount of play in the door latching mechanism and a door seal (weather strip). The output voltage is averaged over a number of closings of the door. In the embodiment of FIG. 8 the output voltage of ten closings of the door is averaged and the result is about 0.4 volts. The output voltage of the door when opened is not averaged when the output voltage is above the alarm threshold value. Instead, the controller 70 is configured to determine an average closed door signal strength over iterations to get an average operational signal strength value for the door closed position and to adjust a threshold value for comparing with the signal strength sensed by the magnetic sensor to determine the door being in the closed position. The controller 70 is configured to compare the signal strength value to an alarm threshold value and output one of a normal state signal and an alarm state signal.

Installations invariably result in the magnet 34 being closer or farther from the Hall effect sensor 82 than an optimal gap distance or spacing. Further, the orientation of the magnet 34 relative to the Hall effect sensor 82 changes the output voltage therefrom. Further each Hall effect sensor 82 has its own tolerance and sensitivity range. Thus, the output voltage from different Hall effect sensors 82 of different door/window magnetic sensing devices 40 varies significantly in the closed position. Further, the Hall effect sensor output voltage is dependent on several factors and cannot be entirely predicted. Therefore, the averaging of a number of output voltage values permits the determination of an average output voltage for assistance in establishing thresholds as discussed below. While the average output voltage is based on ten closings of the door in FIG. 8, other preselected number of occurrences of door closings are contemplated. Further, in one embodiment the averaging only occurs the first ten times the door is closed. In another embodiment, a rolling average occurs, wherein the eleventh and each subsequent time the door is closed, the average output voltage is recalculated based on the most recent stored output voltage measurements. In some embodiments, the alarm threshold value (alarm Th in FIG. 8) is adjusted in view of the average output voltage for when the door closed. The stored output voltages represent signal strength values provided by the Hall effect sensor 82 when the magnet 34 is present corresponding to a closed door. Thus, the output voltages are averaged by the controller 70 to determine an average operational signal strength value for the door/window magnetic sensing device 40. Thus, the controller 70 is configured to process the stored signal strength values to determine an average operational signal strength value.

When the alarm threshold value is exceeded, the controller 70 via the wireless transmitter circuit 86 provides an alarm state wireless signal indicating an alarm state. Of course, when the threshold is not exceeded and tampering is not occurring as discussed below, the controller is configured to control the wireless transmitter circuit 86 to provide a normal state wireless signal.

Second Magnet Tamper Alarm

The controller 70 is also configured to identify when a second magnet is placed near the door/window magnetic sensing device 40 in order to enable opening of a door without the sensing of a voltage beyond the alarm threshold value by the Hall effect sensor 82. Once the door closed "normal" average output voltage is established, an upper tamper state threshold $U_{th}$ and a lower tamper state threshold $L_{th}$ are provided just above and below the average output voltage of the Hall effect sensor 82 when the door is closed. As shown in FIG. 8, the tamper state thresholds have values less than the alarm threshold value.

As shown in FIG. 8, when a second or additional magnet with the same polarity as the magnet 34 is applied near the Hall effect sensor 82, the output voltage thereof is driven below 0.2 volts and is below even with the door open. As the output voltage is below the lower tamper state threshold $L_{th}$, the controller 70 determines that a sabotage attempt based on a separate magnetic field appears to be occurring. After a predetermined or preselected time delay, such as 15 seconds, at a continuous low voltage value, a tamper state wireless signal representing a tamper state is sent by the controller 70 via the wireless transmitter circuit 86 indicating a sabotage attempt. In one embodiment, the predetermined time period is at least about 12 seconds.

If a second magnet with the opposite polarity is applied or placed near to the Hall effect sensor 82 and the output voltage from the Hall effect sensor 82 exceeds the upper tamper state threshold $U_{th}$ for a predetermined time, in some instances, a tamper state wireless signal is output by the controller 70 via the wireless transmitter circuit 86 indicating a sabotage attempt. More specifically, so long as the sensor output voltage is greater than the upper tamper state threshold $U_{th}$ and lower than the alarm threshold for a predetermined time, the controller 70 outputs a tamper state wireless signal. In the instance that the magnetic field of a second tampering magnet is greater than the alarm threshold Alarm Th, but less than the additional tamper threshold, Tamper Th, instead an alarm state wireless signal output by the controller 70 is transmitted by the wireless transmitter circuit 86. In such an instance, if a user cannot ascertain why an alarm state exists, a tamper state or condition will immediately be suspected. When the sensor output voltage exceeds the threshold Tamper Th for a predetermined time, the controller 70 provides a tamper state wireless signal. In one embodiment, three different tamper state wireless signals are provided for the specific tamper state.

The time delay reduces false tamper state wireless signals being output that are caused by a door not fully closing momentarily or when a door is slammed shut. In some embodiments, the upper tamper state threshold $U_{TH}$ or the lower tamper state threshold $L_{TH}$ must be crossed continuously for a preselected time period, such as from about 10 seconds to about 20 seconds, before a tamper state wireless signal is sent by the controller 70 via the wireless transmitter circuit 86.

An installation A embodiment is executed in a similar manner by the controller 70. In one embodiment, the average output voltage from the Hall effect sensor 82 that corresponds to average operational signal strength of a magnetic field in the door closed position is about 1.6 volts. The upper tamper state threshold $U_{TH}$ is greater than 1.6 volts and the lower tamper state threshold $L_{TH}$ is less than 1.6 volts. The alarm threshold value is less than the tamper state thresholds in this embodiment. Thus, the controller 70 is configured to control the wireless transmitter circuit 86 to output an alarm state wireless signal when the signal strength value is below an alarm threshold for installation A. Thus, as set forth above, the controller 70 chooses between either an above alarm threshold value (Installation B) or a below alarm threshold value (Installation A) depending on the orientation of a magnet 34 that is sensed by the Hall effect sensor 82.

Other Features

After the initial installation, the door frame 12 may settle or the door assembly may wear causing a misalignment of the magnet 34 and Hall effect sensor 82. In one embodiment, the controller 70 transmits the output voltage of the Hall effect sensor to a control panel via the wireless transmitter circuit 86. The output voltage value allows the health of the door sensing arrangement 10 and the installation to be checked remotely by the remote device 90 that determines if the output voltage value levels fall too low or too high for reliable operation. In another embodiment, the door/window magnetic sensing device 40 self-monitors the output voltage of the Hall effect sensor 82 and sends a trouble signal if the levels fall too low or too high for reliable operation. In one embodiment, the wireless transmitter circuit 86 uses the ZigBee RF protocol to communicate its alarm state or normal state to the alarm control panel of the remote device 90 via the wireless receiving circuit 104.

Besides state wireless signals, in one embodiment a low voltage trouble signal and an actual analog output voltage of the Hall effect sensor 82 are sent through a radio frequency interface. These signals and voltages allow the position of the magnet 34 to be corrected prior to generating a false alarm due to misalignment of the magnet 34 with respect to the Hall effect sensor 82. Thus, the magnetic field strength can be communicated through the door sensing arrangement to the installer via the remote device 90, or for display on a control panel of a central station, to help trouble shoot problems and verify proper operation and installation.

In some embodiments, the door is a metal door and/or the door frame is a metal door frame. Thus, the output of the Hall effect sensor 1.0 may vary in the open position. The controller 70 accounts for a slight variation and changes the alarm threshold value when the variation is more than a selected amount. Further, providing the Hall effect sensor 82 in the enclosure housing 42 away from a metal door or metal door frame when mounted reduces any magnetic effect of the metal door or metal door frame.

By using a Hall effect sensor 82, instead of other magnetic sensors, the magnet gap distance can be larger due to the increased sensitivity of the Hall effect sensor. This increased sensitivity and larger gap makes the door/window magnetic sensing device 40 easier to install and can accommodate difficult installations.

The door sensing arrangement 10 provides a signal strength indication to the installer. The indication tells the installer that there is significant signal strength margin for a reliable installation. The signal strength margin makes the installation more reliable and reduces false alarms. The make and break distance gap (Hysteresis) of the Hall effect sensor 82 and the magnet 34 is accurately controlled and reduces false alarms from normal door movements. In one embodiment, the make and break distance is automatically optimized by the door/window magnetic sensing device 40 to improve catch performance and reduce false alarms.

Millitesla (mT) is related to the magnetic flux density caused by the distance or gap, along with the orientation of the magnet 34.

While the above discussion is mainly directed to providing the sensing arrangement with a door and door frame, use with various types of window arrangements is also contemplated.

The controller 70 is a processor, microprocessor, ASIC (application-specific integrated circuit) or other device for processing instructions and storing information in a memory. In one embodiment, the controller 70 executes algorithms or other programs to perform an alarm state, normal state and tamper state.

In some embodiments an alarm state signal, a normal state signal and a tamper state signal are not wireless signals.

Thus, the invention provides, among other things, a door/window magnetic sensing device 40 including a magnetic sensor configured to sense signal strength of a magnet and output a signal strength value, and a controller for receiving a signal strength value from the magnetic sensor, the controller configured to determine an alarm state, a normal state, and a tamper state from the signal strength value. Various features and advantages of the invention are set forth in the following claims.

What is claimed is:

1. A door/window magnetic sensing device comprising:

a magnetic sensor configured to sense signal strength of a magnet and output a signal strength value, a wireless transmitter circuit, and a controller for receiving the signal strength value from the magnetic sensor, the controller configured to determine an alarm state, a normal state, and a tamper state from the signal strength value, wherein the controller is configured to control the wireless transmitter circuit to output a normal state wireless signal when the signal strength value is either above an alarm threshold value or below the alarm threshold value depending on orientation of a magnet that is sensed thereby, wherein the controller is configured to determine when the signal strength value is continuously above an upper tamper state threshold and when the signal strength value is continuously below a lower tamper state threshold for a predetermined time period, and wherein the controller configured to control the wireless transmitter circuit to output a tamper state wireless signal when the signal strength value is either continuously above the upper tamper state threshold or continuously below the lower tamper state threshold for the predetermined time period.

2. The door/window magnetic sensing device according to claim 1, wherein the magnetic sensor is a Hall effect sensor, and the Hall effect sensor provides an output voltage when no magnetic field is sensed thereby.

3. The door/window magnetic sensing device according to claim 2, further comprising:

a housing with a mounting plate for mounting in surface-to-surface contact with a door frame, and a printed circuit board disposed within the housing and oriented transverse to the mounting plate, wherein the Hall effect sensor, the controller and the wireless transmitter circuit are provided with the printed circuit board and the Hall effect sensor is disposed on the printed circuit board away from the mounting plate.

4. The door/window magnetic sensing device according to claim 1, wherein the predetermined time period is at least about 12 seconds.

5. The door/window magnetic sensing device according to claim 4, wherein the magnetic sensor is a Hall effect sensor, and the Hall effect sensor provides an output voltage when no magnetic field is sensed thereby.

6. The door/window magnetic sensing device according to claim 1, wherein the upper tamper state threshold and the lower tamper state threshold have values less than the alarm threshold value.

7. The door/window magnetic sensing device according to claim 6, wherein the magnetic sensor is a Hall effect sensor, and the Hall effect sensor provides an output voltage when no magnetic field is sensed thereby.

8. A door/window magnetic sensing device comprising:

a housing, a magnetic sensor disposed in the housing and configured to sense signal strength of a magnet and output a signal strength value, and a controller for receiving the signal strength value from the magnetic sensor, the controller configured to:

compare the signal strength value to an alarm threshold value and output one of a normal state signal and an alarm state signal, store the signal strength value provided by the magnetic sensor when a magnet is present corresponding to a closed door or closed window for at least a preselected number of occurrences, the controller processing the stored signal strength values to determine an average operational signal strength value, and adjust an upper tamper state threshold and a lower tamper state threshold based on the average operational signal strength value.

9. The door/window magnetic sensing device according to claim 8, wherein the controller is configured to provide a tamper state signal when the signal strength value provided by the magnetic sensor is continuously above the upper tamper state threshold or continuously below the lower tamper state threshold for a preselected time period.

10. The door/window magnetic sensing device according to claim 8, further comprising a wireless transmitter circuit for receiving the signal strength value from the controller and transmitting the signal strength value so that a remote device determines whether the signal strength value falls too low or is too high for reliable operation, and wherein the magnetic sensor comprises a Hall effect sensor.

11. The door/window magnetic sensing device according to claim 8, wherein the controller is configured to process the stored signal strength values to determine the operational signal strength value and to adjust the alarm threshold value based on the operational signal strength value.

12. The door/window magnetic sensing device according to claim 8, wherein the controller is configured to determine an orientation of a magnetic field sensed by the magnetic sensor from the signal strength value and to select the alarm threshold value based on the orientation of the magnetic field.

13. Method for installing a door/window magnetic sensing device and a magnet assembly for a door sensing arrangement comprising the steps of:

mounting one of the magnet assembly and the door/window magnetic sensing device to a door or a door frame;

mounting the other of the magnet assembly and the door/window magnetic sensing device to the other of the door or the door frame by:

providing an indication that the magnet assembly and the door/window magnetic sensing device are too far apart to perform door sensing;

providing an indication that the magnet is being detected by a magnetic sensor of the door/window magnetic sensing device as one of the magnet assembly and the door/window magnetic sensing device approaches the other of the magnet assembly and the door/window magnetic sensing device;

providing an indication that the door/window magnetic sensing device is approaching or moving away from the magnet assembly corresponding to an increase or decrease in a signal strength of the magnet sensed by the magnetic sensor; and indicating that the magnet and the magnetic sensor are moved to a position that corresponds to the door/window magnetic sensing device and the magnet assembly being in a closed or shut position and the signal strength of the magnet sensed by the magnetic sensor exceeds a signal strength margin, and securing the approaching one of the magnet assembly and the door/window magnetic sensing device to the other of the door and the door frame at the position wherein the magnetic sensor detects the signal strength of the magnet that exceeds the signal strength margin, wherein the indicator provides an indication that the magnet is being detected by the magnetic sensor as one of the magnet assembly and the door/window magnetic sensing device is approaching the other of the magnet assembly and the door/window magnetic sensing device in response to an increase in the signal strength of the magnet sensed by the magnetic sensor causing flashing of the indicator, the rate of flashing increasing as the magnetic sensor and the magnet approach each other, and wherein a controller is configured to stop the indicator from illuminating when the magnetic sensor detects that the signal strength of the magnet exceeds the signal strength margin.

14. The method according to claim 13, wherein the indicator is a light emitting diode that illuminates to indicate that the magnet assembly and the door/window magnetic sensing device are too far apart to perform door sensing.

15. The method according to claim 13, wherein the controller is configured for receiving the signal strength sensed by the magnetic sensor and for determining an average closed door signal strength over iterations to get an average operational signal strength value for the door closed position and adjusting a threshold value for comparing with the signal strength sensed by the magnetic sensor to determine the door being in the closed position.

16. The method according to claim 13, wherein the magnetic sensor is a Hall effect sensor.

* * * * *